United States Patent [19]

Moore

[11] Patent Number: 5,008,914

[45] Date of Patent: Apr. 16, 1991

[54] QUANTITATIVE IMAGING EMPLOYING SCANNING EQUALIZATION RADIOGRAPHY

[75] Inventor: William E. Moore, Macedon, N.Y.

[73] Assignee: Eastman Kodak Company, Rochester, N.Y.

[21] Appl. No.: 358,239

[22] Filed: May 30, 1989

[51] Int. Cl.[5] ..... H05G 1/44

[52] U.S. Cl. ..... 378/108; 378/146

[58] Field of Search ..... 378/146, 108

[56] References Cited

U.S. PATENT DOCUMENTS 4,454,606 6/1984 Peelihan ..... 378/108

4,857,732 8/1989 Shimura et al. ..... 378/146

FOREIGN PATENT DOCUMENTS 1244971 11/1985 Canada .

OTHER PUBLICATIONS

The article "A Scanning System for Chest Radiography with Regional Exposure Control: Theoretical Considerations" by D. B. Plewes, Med. Phys. 10(5) Sep./Oct. 1983, pp. 646-654 is cited on page 1 line 22 for showing seam equalization apparatus.

The article "Amber: A Scanning Multiple-Beam Equalization System for Chest Radiography" by Vlasbloem and Kool, Radiology, Oct. 1988, pp. 29-34 is cited for showing the use of different control curves in seam equalization radiography.

The article "Exposure Equalization Radiography of the Chest: Clinical Comparison of Slit and Raster Scanning Techniques by Wandtke and Plewes" AJR 144, Jun. 1985, pp. 171-181 is cited for showing slit and raster techniques.

*Primary Examiner*—Craig E. Church

*Attorney, Agent, or Firm*—Thomas H. Close

[57] ABSTRACT

In a scanning equalization radiography system, a control function similar to the exposure response function of the image sensor is employed, whereby the response of the sensor will be linearly related to the x-ray attenuation of an object being radiographed thereby enabling quantitative measurements to be made directly from the radiograph.

10 Claims, 3 Drawing Sheets

QUANTITATIVE IMAGING EMPLOYING SCANNING EQUALIZATION RADIOGRAPHY

TECHNICAL FIELD

The present invention relates to radiography, and more particularly to improvements in scanning equalization radiography.

BACKGROUND ART

Conventional radiography is limited by the small useful exposure range of radiographic film. To overcome this limitation, a system called scanning equalization radiography (SER) has been proposed wherein a beam of radiation is swept over an object to expose an image sensor such as a conventional x-ray film and intensifying screen contained in a cassette. A detector is employed to detect the intensity of the beam after it has passed through the object, and a feedback signal from the detector is employed to modulate the exposure of the beam according to a control function, for example by controlling the output of an x-ray tube. See "A Scanning System for Chest Radiography with Regional Exposure Control: Theoretical Considerations" by D. B. Plewes, Med. Phys. 10(5), Sept/Oct 1983, pp 646–654. By manipulating the control function, it is possible to produce radiographs having various properties of spatial frequency enhancement or attenuation, contrast adjustment, or inversion, and exposure latitude adjustment. Various control functions have been proposed such as attempting to maintain a constant exposure regardless of the object's transmission. Such a control function acts to reject spatial frequencies below the inverse scanning beam width. Other control functions produce modulation at lower spatial frequencies, however the shape of an ideal control function has not been identified.

Several diagnostic imaging procedures are also presently employed to measure quantitative aspects of an object such as thickness and density. Such diagnostic procedures include computed tomography and nuclear magnetic resonance spectroscopy. These diagnostic procedures are preformed with very expensive equipment at a limited number of facilities.

It is the object of the present invention to provide a unique control function for scanning equalization radiography having useful properties, and more particularly it is the object to provide a control function wherein quantitative measurements can readily be made from the resulting image.

SUMMARY OF THE INVENTION

The object of the invention is achieved by providing a control function that is similar to the exposure response function of the x-ray image sensor. When a scanning equalization radiography system is operated with such a control function, it has been discovered that the density of the resulting radiograph will be linearly related to the x-ray attenuation of the object for objects larger than the scanning beam size. As a result, knowing the x-ray absorption coefficient of an object, the thickness of the object can be directly measured from the density of the resulting radiographic image. Similarly, knowing the x-ray absorption coefficient of the material of an object and the thickness of the object, the physical denisty of the object can be measured directly from the density of the radiographic image.

MODES OF CARRYING OUT THE INVENTION

Figure 1:
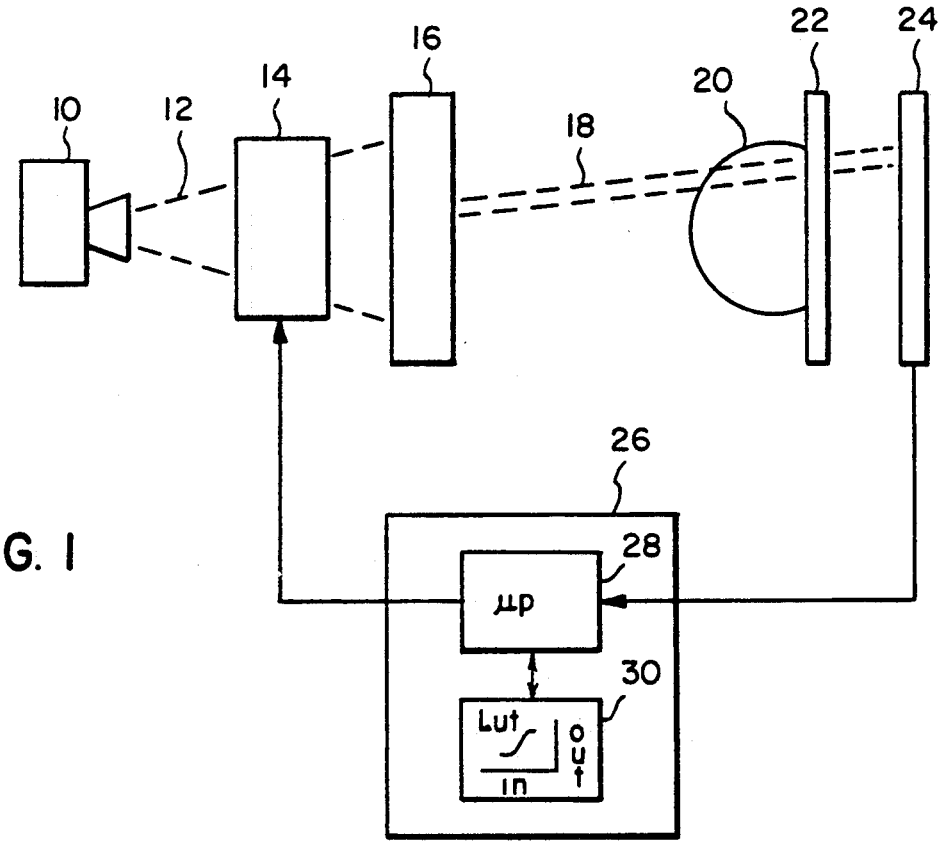
FIG. 1 is a schematic diagram showing a scan equalization radiography system according to the present invention.

Scanning equalization radiography apparatus according to the present invention is shown schematically in FIG. 1. The apparatus includes a source of x-rays 10 for producing a beam of x-rays 12, and means 14 for modulating the exposure provided by the x-ray source 10. The exposure modulation means may comprised for example, electrical means for controlling the duration of pulses produced by the x-ray source, or a mechanically variable aperture means for modulating the intensity of beam 12 from the source as are known in the prior art. The apparatus includes a scanner 16 for producing a scanning beam 18 of x-rays that scan an object 20. The scanning means may comprise for example, the combination of a moveable slit and a rotating wheel having a plurality of radial slits as is known in the prior art. The scanning beam of x-rays 18 exposes an x-ray sensor 22, such as a conventional x-ray film/screen combination in a cassette. A detector 24 detects the intensity of the beam 18 after passing through the object 20 and generates a feedback signal. The detector may be positioned in front of or behind x-ray sensor 22. The detector may be for example, a fluorescence detector comprised of a phosphor that emits light in response to radiation, and a photo detector such as a photo multiplier tube for detecting the emitted light, as is known in the prior art.

The feedback signal generated by the detector 24 is supplied to a feedback control unit 26 that controls the exposure modulator 14 as a function of the object dose rate. The feedback control unit 26 comprises for example, a programmed microprocessor 28 and a memory 30 for storing a lookup table representing the control function provided by the feedback control unit 26.

According to the present invention, the control function stored in lookup table 30 is similar to the exposure response function of the sensor 22. The term "similar" as used herein means that the control function and exposure response function have the same general shape and slopes. By providing a control function that is similar to the exposure response function of the sensor, the density of the image produced by the sensor will be directly proportional to the x-ray attenuation of the objects in the image, thereby facilitating quantitative measurements of the object in the image. For example, the thickness of an object having a known absorption coefficient, such as the human heart chamber, is computed directly from the density of the resulting radiograph. Similarly, the density of the object having a known thickness of a material and a known absorption coefficient, such as bone, is likewise measured directly from the density of the resulting radiograph.

In an x-ray exposure, the transmittance T(x) of an object is given by the ratio of the transmitted exposure I(x) over the incident exposure Io.

$$T(x) = \frac{I(x)}{Io} \quad (1)$$

The transmitted exposure I(x) is determined by Beer's law $$I(x) = Io\, e^{-\int \mu dr} \quad (2)$$

where $\mu$ is the x-ray attenuation coefficient of the object and x is the thickness.

Figure 2:
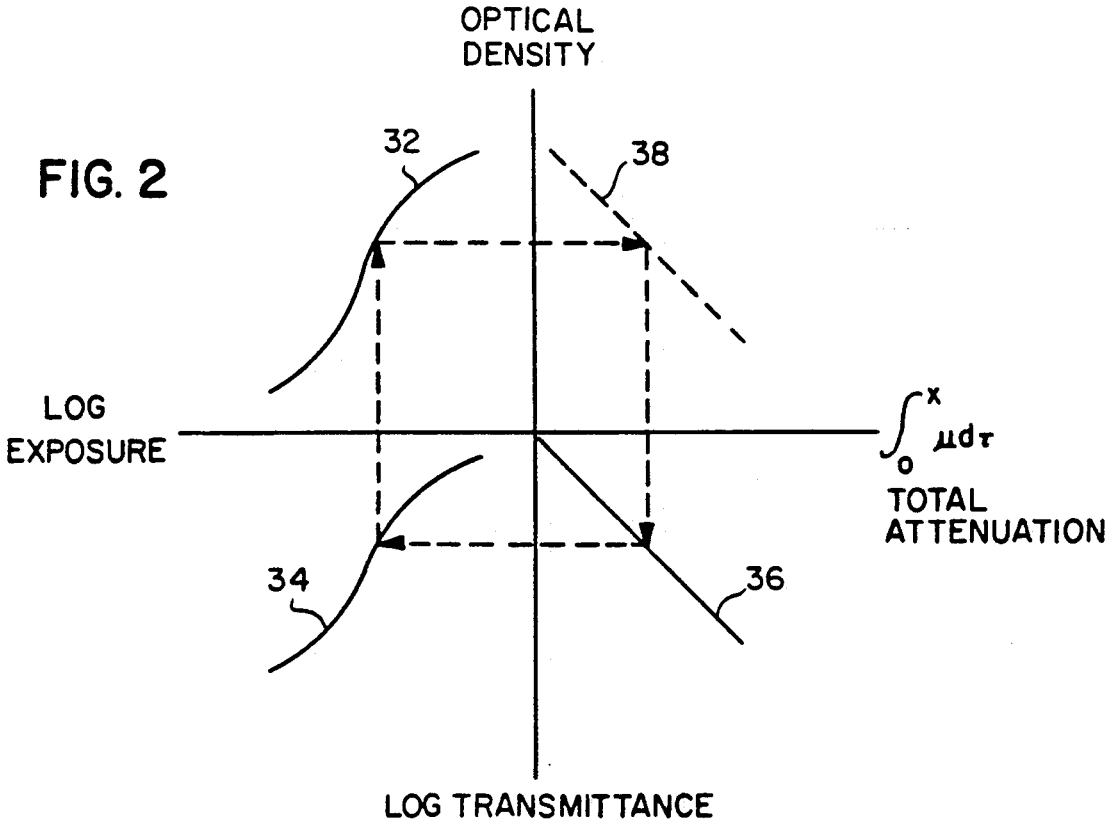
FIG. 2 is a graph showing the exposure response function of a typical film screen radiation image sensor; and the control function for a scanning equalization radiography system according to the present invention.

FIG. 2 is a graph showing a typical D-logE curve 32 representing the exposure response function of a conventional x-ray film screen combination in the upper left quadrant of the graph.

A control function 34 that is similar to the exposure response function is shown in the lower left quadrant. The control function 34 relates the log transmittance to the log exposure by controlling the dose rate as a function of the total dose of x-rays in the scanning equalization radiography system.

Function 36 in the lower right quadrant is the mathematical relationship relating total x-ray attenuation to the log of transmittance T(x), which is simply a straight line with a slope of 0.434.

Finally, function 38 in the upper right quadrant is the relationship between optical density in the radiograph and total x-ray attenuation (which is directly proportional to thickness) resulting from the use of a control function 34 that was similar to the detector response function 32. As can be seen from FIG. 2, the function 38 is simply a linear relationship, which gives the resulting radiograph the very useful property of having densities that are directly proportional to object thickness.

Figure 3:
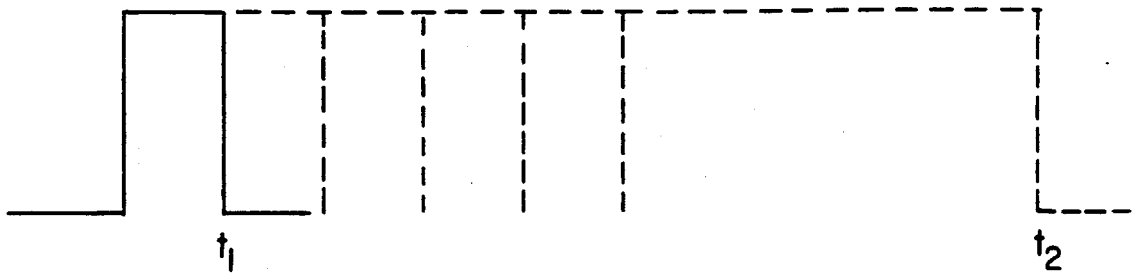
FIG. 3 is a graph useful in describing the control of the x-ray dosage by pulse duration modulation.

Total dose can be controlled by varying the intensity of the x-ray exposure, for example by a variable physical diaphragm or by varying the time of exposure for a constant intensity. The dose rate is measured by sensing the exposure for a predetermined time at the start of an exposure FIG. 3 illustrates how the total dose is controlled in a pulse duration modulation SER system such as that described in the Plewes referenced above. First, the x-ray source is turned on for a predetermined time $t_1$ during which the dose rate is measured by the detector 24 (see FIG. 1). The total dose is then controlled by turning the beam off at some variable time $t_2$ later.

Figure 4:
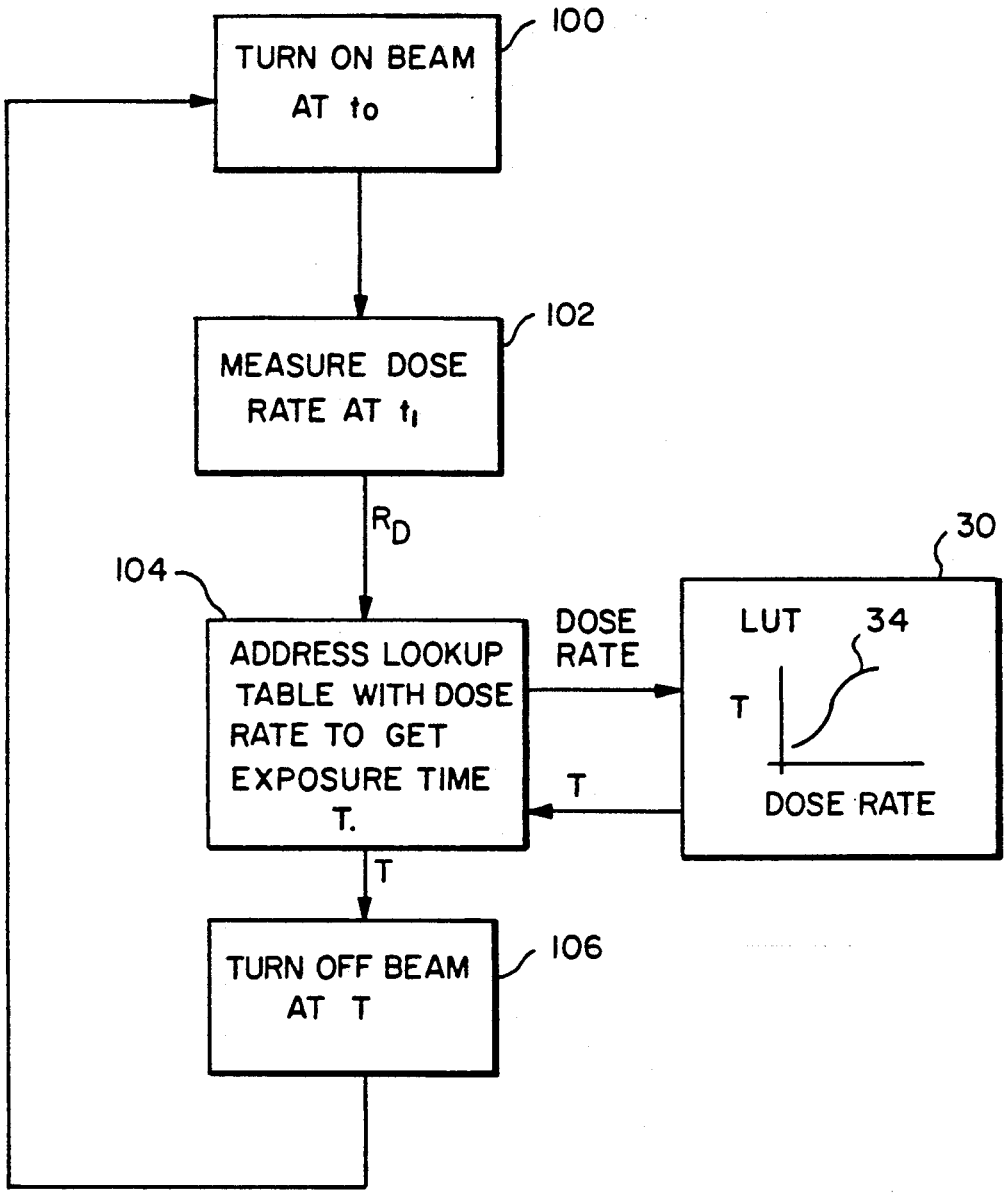
FIG. 4 is a flow chart illustrating the steps of implementing a control function according to the present invention in a scanning equalization radiography system.

FIG. 4 illustrates the steps in the beam control process. For each pulse, the beam is turned on at $t_0$ (100) and the dose rate is measured at $t_1$ (102). The measured dose rate $R_D$ is employed to address the lookup table 30 (104) containing the control function 34 to retrieve the total time T that the beam should be on. The beam is then turned off after the elapse of time T(106). This process is repeated many times for each scan line, and the scan lines are progressably stepped across the object to create the two-dimensional radiograph.

EXAMPLE 1

A scanning equalization system incorporationg:

(a) a grid pulsed x-ray tube;

(b) fore and aft collimators to define and sweep the x-ray beam;

(c) a beam monitor to measure the exposure rate exiting the "patient";

(d) an imaging detector (i.e. an x-ray detector with a high spatial resolution and high signal-to-noise capabilities); and (e) a computer to control the length of the x-ray pulse was designed, the length of the x-ray pulse is based on the x-ray transmittance of the part of the anatomy receiving the x-ray exposure at that instant in time.

The x-ray generator is capable of 650 mA and 150 kVp. The x-ray tube is continuously powered at a filament current corresponsing to 400 mA, and a tube potential of 125 kV.

A grid pulse tank is controlled via the computer. The grid pulse system provides a blocking potential to the x-ray tube's cathode, thereby controlling the flow of electrons from the cathode to the anode of the x-ray tube. The grid pulse tank and its electronic circuitry thus acts as a triode "valve" to switch the x-rays "on" or "off." The x-ray filament current is constant, so the grid pulse system controls the total x-ray exposure in any one pulse by controlling the length (in milliseconds) of the x-ray pulse.

Fore and aft collimators define an x-ray beam of 0.25 square centimeters (0.5 centimeters across by 0.5 centimeters high), and sweep the beam across the patient in a raster fashion.

During operation, the pulse tank is sent an electrical signal to turn "on" the x-ray beam. The monitor system, which is located behind the "patient" detects the x-radiation transmitted by the "patient." The dose rate at this monitor is directly related to the transmittance of the patient at that instant. Based on the measured dose rate, the computer retrieves a predetermined value from a lookup table, to determine how long to leave the x-ray beam "on" om order to obtain the desired total exposure value to the imaging detector, thereby "equalizing" the exposure to the imaging detector.

Exposure times range from 50 microseconds to 700 microseconds. After a time increment of 700microseconds or less, the x-ray beam is turned "off" by the pulse tank system. After a time increment of 1000 microseconds (1 millisecond) from the time the x-ray beam was first turned on (independent of the length of the x-ray pulse) the pulse system is sent another signal to turn "on" the x-rays, and the process is repeated.

The beam is swept across the patient at a rate of 0.25 centimeters per millisecond, or 0.25centimeters per pulse. Thus there are 4 individual x-ray pulses to each body part (2 across and 2 down in the $0.5 \pm 0.5$ centimeter x-ray beam). A complete scan is accomplished in approximately 24 seconds.

The system was operated using KODAK Lanex Regular screens and KODAK TMat-G film. The film was processed in a controlled KODAK M6-AW film processor. The sensitometry of the film as shown by curve 32 in FIG. 2 was checked frequently with control strips.

The lookup table in the computer, which controls the generation of the "off" signal for the x-ray beam, was configured so that the log exposure versus the log exposure rate (i.e. the log transmittance) function (curve 34 in FIG. 2) was identical in shape to the Density-Log Exposure function (curve 32 in FIG. 2) of the Kodak Tmat-G film.

With this "control curve," the image produced represented a "map" of the relationship:

$$D = m \int_0^x \mu d\tau + b,\ m = \text{slope of line},\ b = \text{intercept}.$$

$$\Delta \frac{\Delta D}{\int_0^x \mu d\tau} = m$$

Thus the density of the film was directly proportional to the integral, or sum of differentials, of the x-ray attenuation.

The image is perfectly suitable for normal interpretation by a physician. However, if it is required to determine quantitative data from the image, the physician can make a simple measurement with a film densitometer, and determine relative (percentage) thickness variations. Thus, by a simple measurement the physician can tell, for example, that a blood vessel is reduced in caliber by ½ from its adjoining size. Or, the physician can determine that a heart chamber is not of the right shape, again by simple densitometric measurement.

Alternatively, by comparing the density to aluminum and plastic calibration values, obtained in exposures of two different x-ray energies, a very simple and elegant energy subtraction image can be obtained. By exposing two images at different energies, processing according to the disclosed method, and subtracting the densities of the resulting images, the difference image is a record of the energy difference. This avoids the need for complicated signal processing employed in prior art energy subtraction radiography.

EXAMPLE 2

Figure 5:
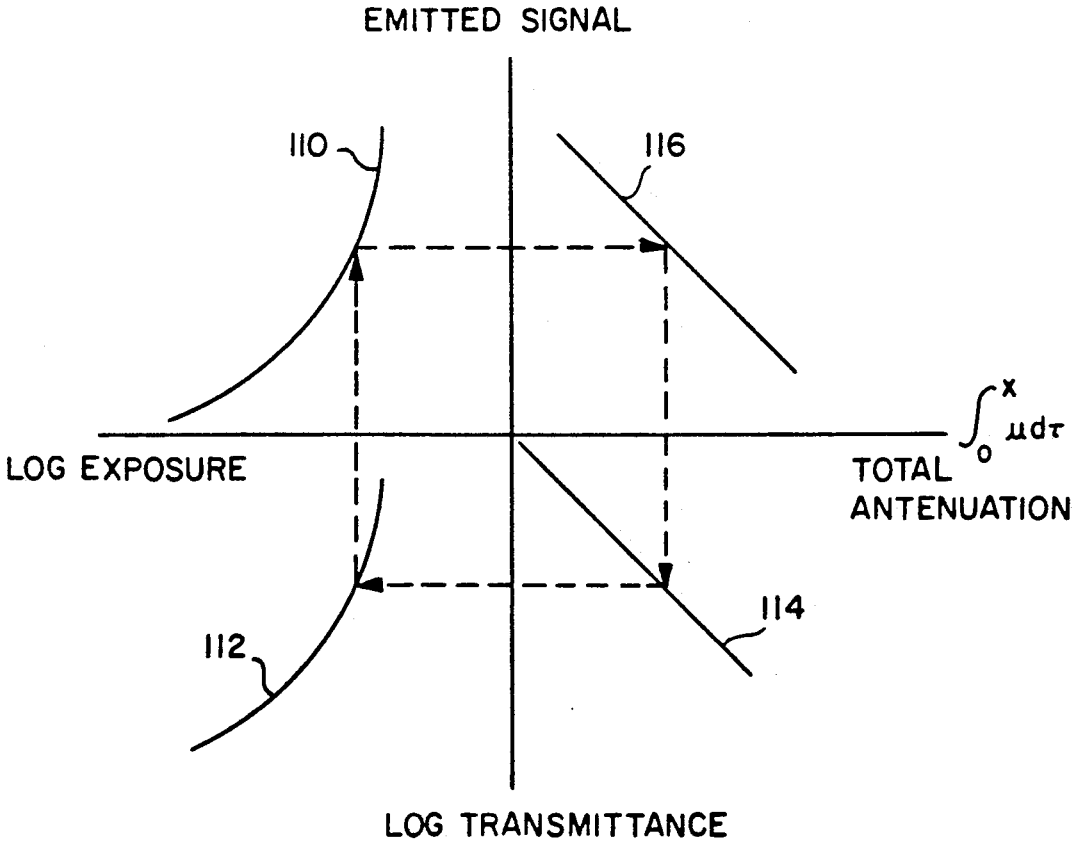

In a second example, the film/screen x-ray sensor was replaced with a stimulable storage phosphor plate of the type that is exposed with x-rays to create a latent image, and is stimulated with infrared radiation to cause the plate to emit image-wise radiation in the visible portion of the spectrum. FIG. 5 is a graph showing the response function 110 of the stimulable phosphor in the upper left quadrant. Since the emitted signal from a storage phosphor plate is linearly proportional to the exposure reaching the plate, the log exposure versus emitted signal response function is an exponential curve 110. For this example, the lookup table relating the dose rate to the total dose, and hence the log transmittance to log exposure was configured to have the same exponential shape. This function 112 is shown in the lower left quadrant of FIG. 5.

The function 114 relating total attenuation to log transmittance is the same as shown in FIG. 2 above. The emitted signal from the storage phosphor was linearly related to the total attenuation, and hence the thickness of the object, as shown by the function 116 shown in the upper right quadrant of FIG. 5 is linearly related to the intensity of the stimulated signal emitted by the phosphor.

INDUSTRIAL APPLICABILITY AND ADVANTAGES

The scanning equalization radiography system of the present invention is useful in diagnostic radiography, and is advantageous in that the method enables quantitative thickness measurements to be directly made from the radiography.

I claim:

1. An improved scanning equalization radiography system of the type having a means for scanning a beam of radiation over an object to expose a sensor for forming an image of the object, the sensor having an exposure response function;

a detector for monitoring the intensity of the beam after passing through the object to produce a feedback signal; and control means responsive to the feedback signal to control the exposure produced by the scanning beam according to a control function, wherein the improvement comprises;

the control function having the same general shapes and slopes as the exposure response function of the sensor.

2. The improvement claimed in claim 1, wherein the sensor is a conventional x-ray film having a D-logE curve response function and intensity screen combination, and the contol function is the D-logE curve of the film.

3. The improvement claimed in claim 1, wherein the sensor is a stimulable storage phosphor plate, and the control function is the log exposure versus emitted signal response of the plate.

4. The improvement claimed in claim 1, wherein the control means is a microcomputer, and the control function is stored as a lookup table in a memory of the microcomputer.

5. A method of performing scan equalization radiography of the type where a beam of radiation is scanned over an object to expose a sensor, and the intensity of the beam passing through the object is detected and the exposure of the beam is controlled according to a control function, comprising the steps of:

a. measuring the exposure response function of the sensor; and b. adjusting the control function to be similar to the exposure response function of the sensor.

6. The method claimed in claim 5, wherein the sensor is a conventional x-ray film having a D-logE curve response function and intensifying screen combination, and the control function is the D-logE curve of the film.

7. The method claimed in claim 5, wherein the sensor is a stimulable storage phosphor plate, and the control function is the log exposure versus emitted signal response of the plate.

8. A method of measuring the thickness of an object having a known x-ray absorption coefficient, comprising the steps of:

a. preparing a radiograph employing a scanning equalization readiography system of the type having a means for scanning a beam of radiation over an object to expose a sensor for forming an image of the object, the sensor having an exposure response function, and employing a control function in the scanning equalization radiography that has the same general shape and slopes as the exposure response function of the sensor.

b. measuring the density of the object in the radiograph; and c. computing the thickness of the object as a function of the density and the known absorption coefficient.

9. The method claimed in claim 8, wherein the object is an anatomical structure such as a human heart.

10. A method of measuring the density of an object having a known thickness, comprising the steps of:

a. employing a scanning equalization radiography system of the type having a means for scanning a beam of radiation over an object to expose a sensor for forming an image of the object, the sensor having an exposure response function, and employing a control function in the scanning equalization radiography that has the same general shape and slopes as the exposure response function of the sensor to produce a radiograph;

b. measuring the optical density of the object in the radiograph; and c. computing the physical density of the object as a function of the optical density and the known thickness.

* * * * *